US007543343B1

(12) United States Patent
Hui

(10) Patent No.: US 7,543,343 B1
(45) Date of Patent: Jun. 9, 2009

(54) SLEEPING BAG

(76) Inventor: John Hui, 7373 Hunt Ave., Garden Grove, CA (US) 92841

( * ) Notice: Subject to any disclaimer, the term of this patent is extended or adjusted under 35 U.S.C. 154(b) by 1653 days.

(21) Appl. No.: 10/229,083

(22) Filed: Aug. 28, 2002

(51) Int. Cl.
*A47G 9/08* (2006.01)

(52) U.S. Cl. ..... 5/413 R

(58) Field of Classification Search ..... 5/413 R, 5/413 AM, 486, 482, 502, 485
See application file for complete search history.

(56) References Cited

U.S. PATENT DOCUMENTS

| | | | | | |
|---|---|---|---|---|---|
| 622,812 | A | * | 4/1899 | Lapierre | 5/413 R |
| 2,060,092 | A | * | 11/1936 | Lucas | 5/413 R |
| 2,368,220 | A | * | 1/1945 | Hinds | 5/413 R |
| D158,556 | S | | 5/1950 | Corrao | |
| 4,197,601 | A | | 4/1980 | Maguire | |
| 4,507,805 | A | | 4/1985 | Calutoiu | |
| 4,605,029 | A | * | 8/1986 | Russell | 135/125 |
| 4,757,832 | A | * | 7/1988 | Russell | 135/128 |
| 5,005,235 | A | * | 4/1991 | Huang | 5/413 R |
| 5,125,547 | A | * | 6/1992 | Russell | 224/637 |
| 5,386,602 | A | | 2/1995 | Krenzler | |
| D405,585 | S | | 2/1999 | Stevens | |
| 5,881,405 | A | | 3/1999 | Garrigues | |
| 6,175,976 | B1 | | 1/2001 | Cantwell | |

OTHER PUBLICATIONS

Internet article "Upgrade Bivy", Feb. 29, 2000.*
Internet article, "Kelty Lightyear 3D Sleeping Bag", undated.*
Internet article, "BackpackGearTest", undated.*
Internet article, "Mountain Hardware Micro Mesh Bivy" Nov. 5, 2003.*

* cited by examiner

*Primary Examiner*—Sunil Singh
(74) *Attorney, Agent, or Firm*—Cislo & Thomas, LLP

(57) ABSTRACT

An article of bedding, such as a sleeping bag, is constructed so as to allow a user to selectively and alternatively control the insulating properties of the covering structure over the user's feet. Specifically, the lower portion of a main cover layer of a blanket or main sleeping bag cover is provided with an overlying top covering layer. Also, a slit is defined transversely across the lower portion of the main covering layer between about one foot and about three feet from the foot extremities of the blanketing layers. The user selectively inserts his or her feet either beneath both covering layers, or through the slit in the main covering layer. When the user's feet are inserted through the slit, they are covered only by the top covering layer below the slit. Preferably, the foot extremities of the top covering layer and the main covering layer are provided with an open-mesh ventilating panel therebetween. This permits air circulation in between the lower portion of the main cover layer and the overlying top cover layer to prevent the user's feet from becoming too warm. The foot extremities of the main cover layer and top covering layer may be releasably secured to the other by a zipper or some other releaseable closure device.

11 Claims, 4 Drawing Sheets

SLEEPING BAG

BACKGROUND OF THE INVENTION

1. Field of the Invention

The present invention relates to articles of bedding, and sleeping bags in particular.

2. Description of the Prior Art

Sleeping bags have long been used by campers either for sleeping outdoors or sleeping in tents. Sleeping bags are also utilized indoors when a bed is not conveniently available.

A conventional sleeping bag is typically constructed from thermally insulated sheet-like layers of materials, often filled with thermally insulated padding. A typical sleeping bag is constructed of an expanse of a generally rectangular, multiply fabric pad folded linearly in half and having interengageable zipper strips extending about the peripheral, unfolded edges where the unfolded edges of the halves of the folded pad meet. In some sleeping bags the padding on one side of the longitudinal fold may be heavier than on the other and may even include padding to serve as a pillow at the top end. The heavier side of the structure then serves as a bottom mat layer. In any event, even when the layers of material are equally padded, one-half of the expanse of the pad serves as a mat to support the occupant's body from beneath, while the other half is folded over the occupant's body to serve as a main cover.

Conventional sleeping bags are typically constructed so as to keep the occupant warm in chilly, or even very cold, ambient temperatures. Conventional sleeping bags are designed in different weights and with different insulating characteristics depending upon the temperatures of the environments in which they are to be utilized. Nevertheless, virtually all sleeping bags are designed to provide maximum warmth to an occupant for the temperature conditions in which use is contemplated.

However, quite often a sleeping bag will be utilized in ambient temperatures well above the lowest temperature for which the sleeping bag is designed. Under such circumstances, the occupant often becomes uncomfortably warm when covered by the main covering layer of the sleeping bag. In particular, an occupant's feet and legs may become uncomfortably warm due to retained body heat trapped between the layers.

While an occupant can always merely throw back the main cover to cool off, this practice is often unacceptable in environments in which sleeping bags are frequently used. Specifically, when the main covering layer of a sleeping bag is thrown off of the occupant's body, the occupant is subjected to attack by flying and crawling insects. Thus, the occupant is faced with the undesirable choices of remaining beneath the main covering layer of the sleeping bag and thus remaining uncomfortably warm, or exposing his or her body to the annoyance, discomfort, and pain of insects.

A further disadvantage of merely throwing off the covering layer of a conventional sleeping bag is that only the feet and lower legs of the occupant may be uncomfortably warm when encapsulated between the mat layer and the main covering layer of the sleeping bag, while the occupant's upper body may at the same time be quite comfortable. Consequently, if the occupant merely pulls back the top covering layer of the sleeping bag, the occupant's torso may feel chilly, even though the occupant's legs and feet are uncomfortably warm.

SUMMARY OF THE INVENTION

The present invention involves a modification to the construction of an otherwise conventional sleeping bag having a main cover and bottom layers which are permanently secured lengthwise along one side, and secured by a zipper or some other releaseable fastening system along the other side and across the foot extremities of the layers. According to the invention the main covering layer is created with a transverse slit that is wide enough for a person to put his or her legs through. This slit is parallel to the bottom of the sleeping bag and located at about the level of a person's shins. Atop the leg area portion of the sleeping bag a top half length cover is placed and is permanently secured along the sides of the main cover layer. The top cover includes a collapsible mesh end panel extending across an end opening between the top cover and the main cover layer of the sleeping bag. The mesh has a size sufficient to allow air circulation, but is small enough to exclude insects. In addition, another zipper is provided extending transversely across the foot of the sleeping bag to releasably join the main cover layer and the top cover layer disposed on top of the main cover layer together with a zipper slide.

The user can thus utilize the improved sleeping bag of the invention in at least three different ways. In relatively warm ambient air, the user inserts his or her feet through the slit in the main cover layer and unzips completely the zipper slide on the upper zipper between the main cover layer and the top cover layer located thereabove. The user's feet are then inserted into the area between the main cover layer of the sleeping bag and the top cover layer located above it. The user's feet will then remain relatively cool due to air circulation flowing through the mesh panel that extends between the main cover layer of the sleeping bag and the top cover layer located above it. Alternatively, the user can completely or partially close the opening between the main cover layer of the sleeping bag and the top half length cover layer above it to reduce air circulation into the bag from the outside. In a further manner of use the user withdraws his or her feet from the slit and inserts them beneath the main cover layer and the bottom mat layer of the sleeping bag, thereby utilizing the sleeping bag in a conventional manner.

In one embodiment of the invention the short or half length top layer can be totally unzipped from the main cover layer so that the sleeping bag becomes a conventional one. Furthermore, the short top layer can be formed of different materials, so that different weight top half length layers can be used interchangeably atop the main cover layer for different weather and climate conditions.

Construction of a bedding article according to the present invention is not limited to a sleeping bag. Quite to the contrary, the same unique construction may be applied to other articles of bedding, such as blankets. In particular, older people often use double layers of blankets over their feet at night. They sometimes remove the top blanket covering their feet should their feet become excessively warm during the night. However, a blanket constructed according to the present invention may be provided with a main cover layer and a top covering layer over the lower leg portion of the main cover layer. A slit is defined through the main cover layer of the blanket beneath the top covering layer so that the blanket may be utilized in the same manner previously described for a sleeping bag. Thus, a user need not throw off an unwanted blanket from his or her feet during the night, but merely inserts his or her feet through the slit in the main blanket layer so that the feet remain covered by the top layer, and are not excessively warm.

In one broad aspect the present invention may be considered to be a bedding article for accommodating the body of a person. The bedding article of the invention is comprised of an elongated main cover layer of flexible material having an upper body portion and also a lower body portion with a foot extremity. A transverse slit is defined in the lower body portion between said upper body portion and said foot extremity. A top cover layer overlies the lower body portion of said main cover layer and is secured thereto, either permanently or removably. A person is thereby able to lay beneath the main cover layer with his or her feet covered by both the lower body portion and the top cover layer. Alternatively, the user can insert his or her feet through the slit defined in the lower body portion of the main cover layer so that the feet are covered only by the top cover layer.

The invention has particular applicability to sleeping bags. In a sleeping bag structure, the bedding article is further comprised of an elongated bottom layer of flexible material underlying the main cover and having an upper body portion with a head extremity and also a lower body portion with a foot extremity. The user lays upon the elongated bottom layer, which serves as a mat, with the main cover layer overlying the body of the user and the top cover layer overlying only the lower body portion of the main cover layer.

In another aspect the invention may be considered to be a sleeping bag comprising: an elongated bottom mat formed of flexible material and having opposing head and foot extremities; an elongated main cover also formed of flexible material and having head and foot extremities and overlying the bottom mat and permanently secured thereto and having a transverse slit defined therethrough at a location closer to the foot extremity than to the head extremity; and a top cover secured to the main cover and also formed of a flexible material and overlying only a portion of the main cover, including the foot extremity and the transverse slit.

In preferred embodiments of the invention the layers of flexible material are each formed with opposing longitudinal edges and all of the layers are permanently joined to each other along at least one of the longitudinal edges. Preferably also, the top cover layer has a foot extremity and the bedding article is further comprised of an upper fastening system releasably joining the foot extremity of the top cover layer to the foot extremity of the bottom covering layer. The upper fastening system is typically formed of a pair of transverse strips of interengageable zipper teeth. One strip is attached transversely across the foot extremity of the main cover layer while the other strip is attached transversely across the foot extremity of the top cover layer. A zipper slide is provided for releasably engaging the teeth of the complementary zipper strips together.

However, alternative fastening systems may also be used. For example, the top cover layer and the main cover layer may be joined to each other by flexible hook and loop fabric fastener strips of the type sold under the registered trademark Velcro@. Also, the foot extremities of the top cover layer and the main cover layer may be joined to each other by snap fasteners. Other conventional fastening systems may also be utilized.

In some embodiments of the invention the bedding article may be further comprised of a flexible, ventilated mesh panel joined to and extending between the foot extremities of the top cover layer and the main cover layer. Also, when the article of bedding is a sleeping bag, it is further comprised of an elongated bottom mat layer of flexible material underlying the main cover layer and having an upper body portion with a head extremity and a lower body portion with a foot extremity. Preferably, a lower fastening system releasably joins the foot extremities of the main cover layer and the bottom mat layer together. Again, this fastening system may be comprised of a pair of strips of interengageable zipper teeth that are secured and released relative to each other by means of a zipper slide, Velcro® hook and loop fabric fastener strips, or snap fasteners.

In still another aspect the invention may be considered to be an improvement in a sleeping bag including an elongated, flexible bottom mat with opposing first and second longitudinally engaged portions, an elongated main cover secured to the bottom mat and having opposing first and second longitudinally arranged portions respectively overlying the first and second portions of the bottom mat. According to the improvement of the invention an upper top cover overlies only the second or lower body portions of the main cover and the bottom mat. Also, a transverse slit is defined through and transversely across the second portion of the main cover to accommodate the insertion and removal of the feet of a sleeping bag occupant.

The invention may be described with greater clarity and particularity by reference to the accompanying drawings.

DESCRIPTION OF THE EMBODIMENT

Figure 1:
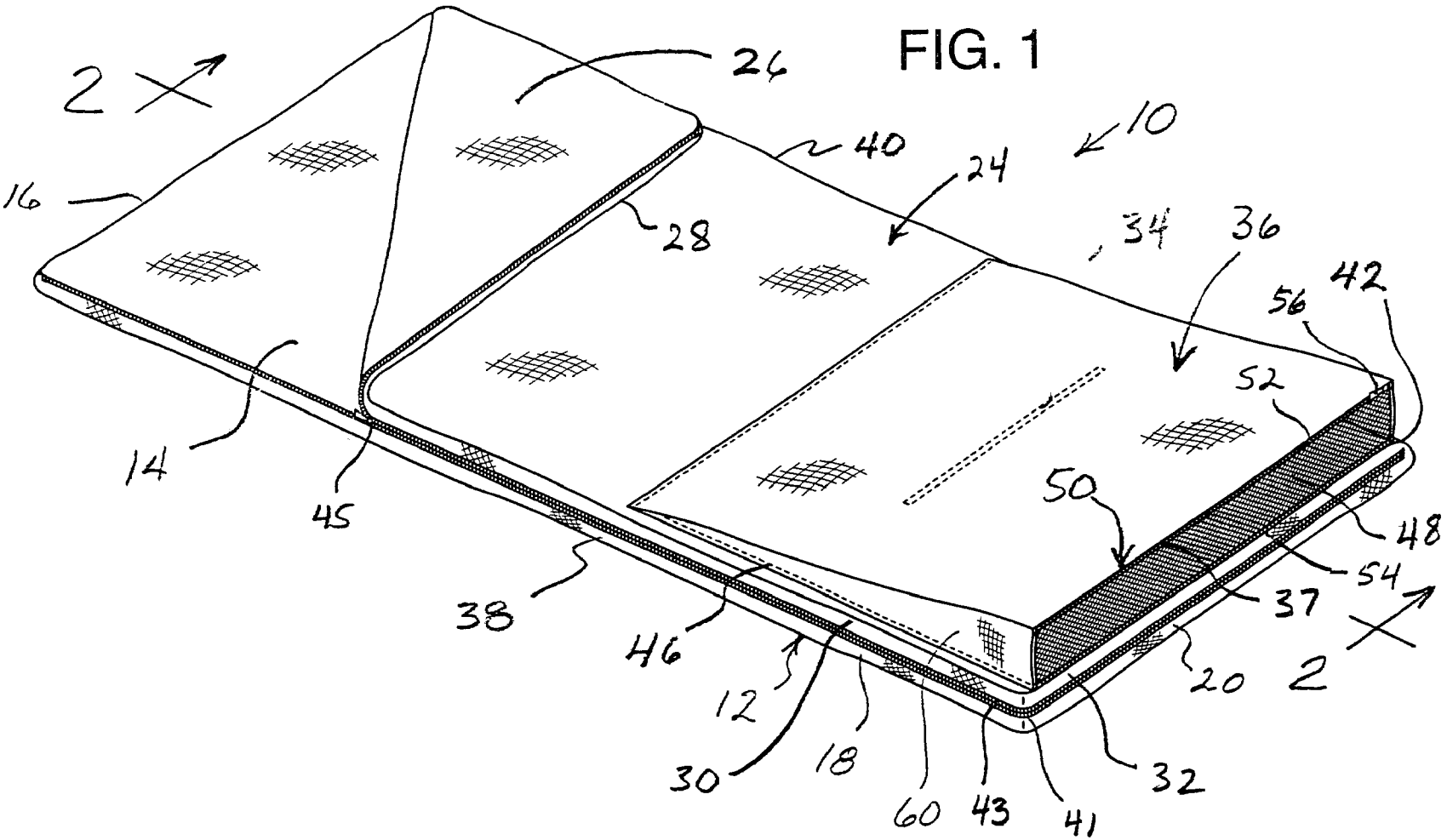
FIG. 1 is a perspective view of a preferred embodiment of a sleeping bag constructed according to the invention.

FIG. 1 illustrates a sleeping bag indicated generally at 10. The sleeping bag 10 includes an elongated, padded bottom layer 12 having a first upper body portion 14 with a head extremity 16 and a second lower body portion 18 with a foot extremity 20. The bottom layer 12 is typically padded with insulating material and forms a mat to support the body 22 of a user from beneath, as illustrated in FIG. 2.

The sleeping bag 10 is further comprised of an elongated main cover layer 24 which is also formed of flexible material. The main cover layer 24 overlies the bottom layer 12 and also has a first upper body portion 26 with a head extremity 28 and a second lower body portion 30 with a foot extremity 32. A transverse slit 34 is defined through the main cover layer 24 across the width of the main cover layer 24 in the lower body portion 30 between the upper body portion 26 and the foot extremity 32. The slit 24 is located between about one foot and about three feet from the foot extremity 32, typically about eighteen inches therefrom. The sleeping bag 10 is further comprised of a top cover half length layer 36 overlying only the lower body portion 30, and not the upper body portion 26 of the main cover layer 24. The top cover layer 36 extends longitudinally only about one-half the length of the main cover layer 24 and the bottom mat layer 12. The top cover layer 36 has a foot extremity 37 at one end and terminates at about the demarcation between the upper body portion 26 and the lower body portion 30 of the main cover layer 24.

The layers 12, 24, and 36 are each formed with opposing longitudinal edges, indicated as a right-hand edge 38 and a left-hand edge 40 in FIG. 1. The layers 12, 24, and 36 may all be permanently joined to each other along at least one of the longitudinal edges 38 and 40. In the embodiment of the invention illustrated, the layers 12, 24, and 36 are all permanently joined together along the left-hand longitudinal edge 40. More specifically, the main cover layer 24 is permanently joined to the bottom mat layer 12 along the left longitudinal edge 40, since these two layers are constructed as halves of a large, expansive, thick, rectangular pad folded in half as indicated at 42 to form the left-hand edges 40 of the top cover layer 24 and the bottom mat layer 12. The transverse edges at the head extremities 16 and 28 of the bottom layer 12 and main cover layer 24, respectively, and the transverse edges formed at the foot extremities 20 and 32 of the bottom layer 12 and main cover layer 24, respectively, as well as the right side edges 38 of the two layers 12 and 24 are releasably fastened together by zipper strips 41 and 43 having interengageable teeth that are alternatively coupled together or released from each other by a conventional zipper slide 45. In the embodiment shown, the top cover layer 36 is permanently joined to the main cover layer 24 along both longitudinal edges 38 and 40 by lines of stitching, one of which is visible at 46 in FIG. 1.

Figure 2:
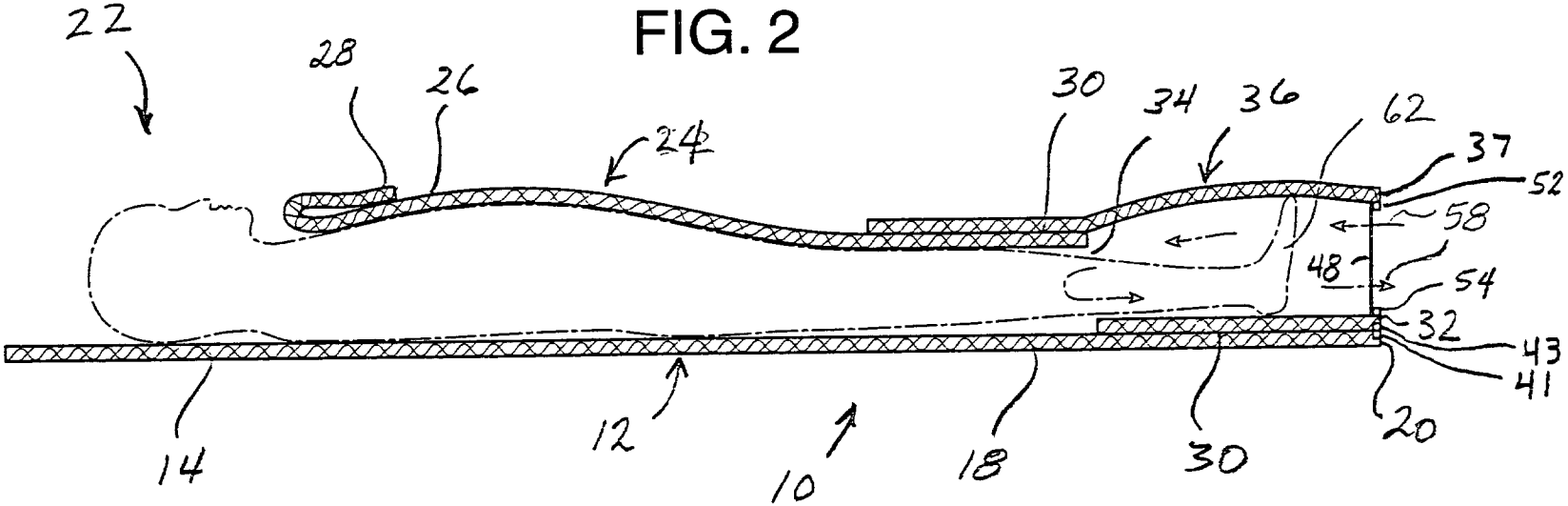
FIG. 2 is side sectional view taken along the lines 2-2 of FIG. 1.

As best illustrated in FIGS. 1 and 2, a ventilated, transversely extending rectangular-shaped mesh panel 48 is provided at the foot extremity 37 of the top cover layer 36 and the foot extremity 32 of the main cover layer 24 and is secured thereto by means of a conventional zipper 50. The zipper 50 has a pair of zipper strips 52 and 54, respectively attached to the foot extremity 37 of the top cover layer 36 and the foot extremity 32 of the main cover layer 24. The zipper strips 52 and 54 have interengageable zipper teeth that are secured together by means of a zipper slide 56.

Figure 3:
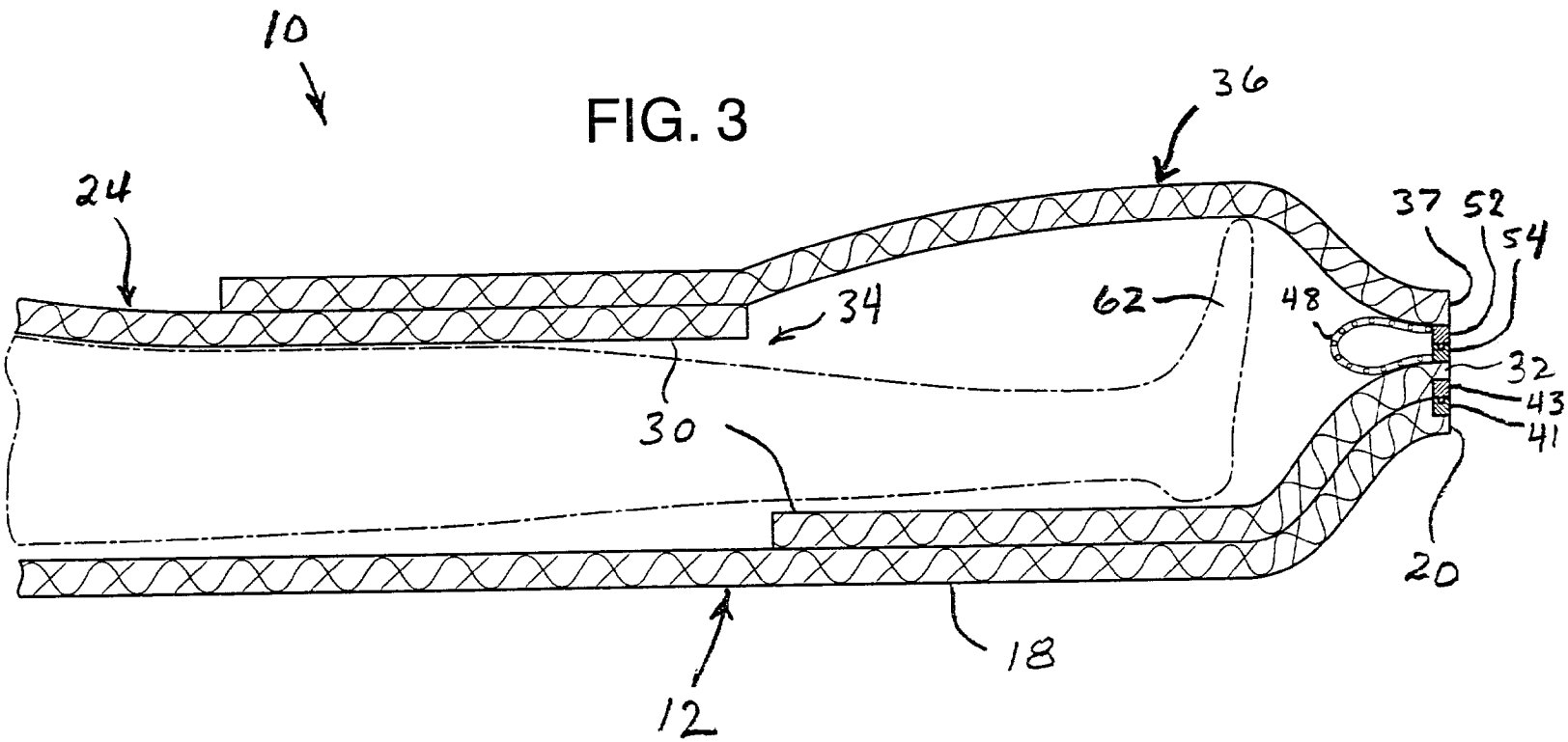
FIG. 3 is a sectional elevational detail illustrating how a user may cover his or her feet with only the top cover layer of the sleeping bag of FIG. 1 with the foot extremities of the cover layers closed.

The zipper 50 formed by the zipper strips 52 and 54 and the slide 56 serves as an upper fastening system that allows the flexible mesh panel 48 to be opened for ventilation, as illustrated in FIGS. 1 and 2, or closed to retain body heat, as illustrated in FIG. 3. The mesh of the ventilating panel 48 is fine enough to prevent the entry of insects in between the main cover layer 24 and top cover layer 36 at the foot extremities thereof when the mesh panel 48 is open, as illustrated in FIGS. 1 and 2. However, the mesh openings are large enough to permit air circulation when the zipper 50 is unzipped, as indicated by the directional arrows 58 in FIG. 2.

As illustrated in FIG. 1, the top cover panel layer 36 is provided with elongated, triangular-shaped expansion panels 60 at both of the longitudinal side edge 38 and 40. The expansion panels 60 permit the foot extremity 37 of the top cover layer 36 to be lifted and separated several inches from the foot extremity 32 of the main cover layer 24, thus affording a sufficient area for air to circulate as indicated at 58.

The sleeping 10 of the invention may be utilized in several different ways. As illustrated in FIGS. 1 and 2, the user 22 may lie on the bottom mat layer 12 with the main cover layer 24 pulled up over the user's torso and with the user's feet 62 inserted through the transverse slit 34 in the main cover layer 24 with the zipper 50 unzipped. With the sleeping bag 10 in this condition the upper body portion 26 and the upper part of the lower body portion 30 of the main cover layer 24 above the slit 34 reside atop the body of the user 22, while the user's lower calves and feet 62 rest atop the lowermost part of the lower body portion 30 of the main cover layer 24 that resides between the slit 34 and the foot extremity 32.

The top cover layer 36 is typically fairly light in weight so that the user's feet 62 do not become unduly warm from trapped body heat. Furthermore, since the user's toes typically prop the lower end of the top cover layer 36 upwardly, pushing it away from the underlying lower portion of the main cover layer 24, the foot extremities 37 and 32 of the top cover layer 36 and bottom cover layer 24, respectively, are spread vertically apart. This opens up the mesh panel 48 to air circulation between the vertically separated foot extremities 32 and 37 of the main cover layer 24 and top cover layer 36, respectively. The user's feet 62 are thereby cooled both by the air circulation indicated at 58, and by the single layer, relatively light-weight insulation provided by the top cover layer 36.

In slightly cooler conditions the user may still wish for his or her lower extremities to be covered only by the top cover layer 36 but may also wish to eliminate drafts through the mesh panel 48, which may be too cool for comfort if ambient temperature falls. In such a situation, the user operates the slide 56 of the zipper 50 to draw the zipper strips 54 and 56 together and interengage their zipper teeth to bring the foot extremities 32 and 37 of the main cover layer 24 and top cover layer 36 together, as illustrated in FIG. 3. With the zipper 50 closed, as illustrated in FIG. 3, the mesh panel 48 is folded inwardly and entrapped within the confines of the sleeping bag 10. The user's feet 62 are still covered by only the light layer of insulating material afforded by the top cover layer 36, but are not subject to the cooling effects of air circulation through the mesh panel 48.

Figure 4:
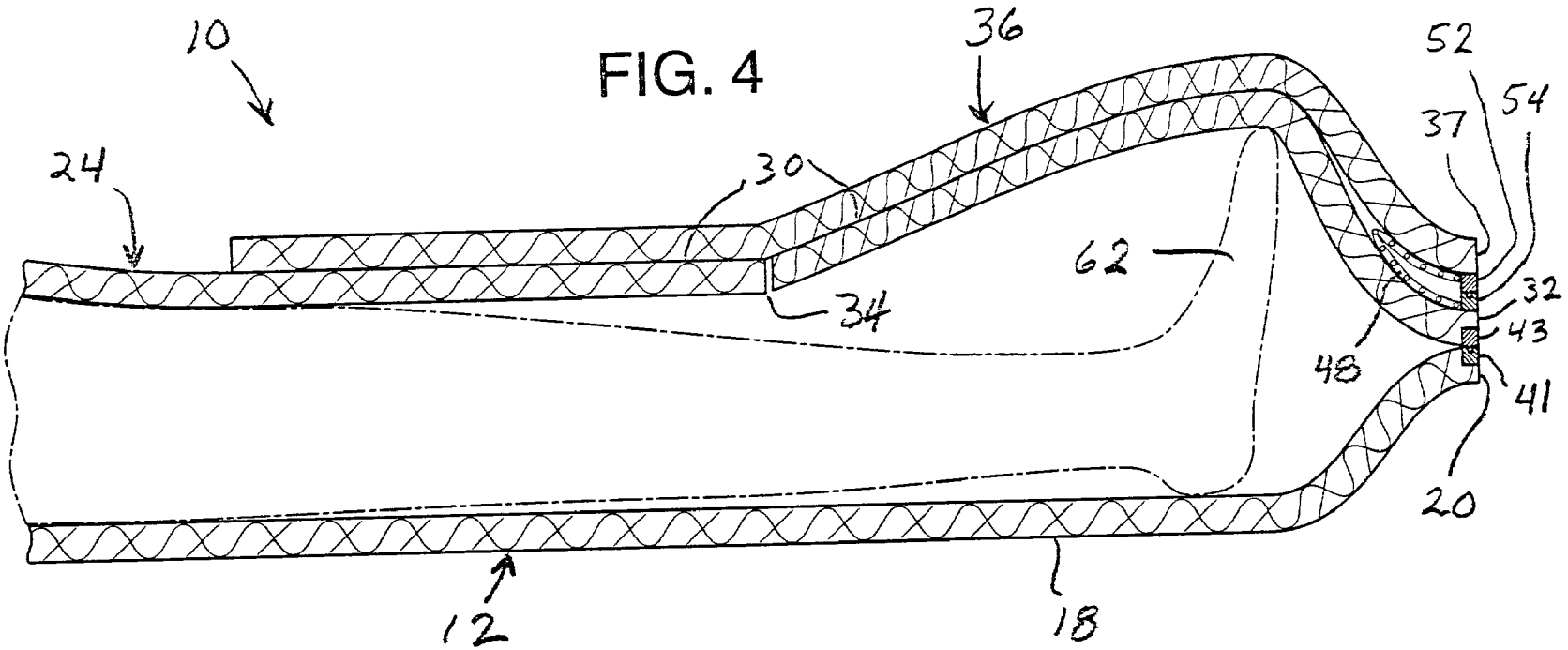
FIG. 4 is a sectional elevational detail illustrating how a user may cover his or her feet with both the main cover layer and top cover layer of the sleeping bag of FIG. 1.

In still cooler weather the user 22 may wish to keep his or her feet 62 even more fully covered. This may easily be done without undoing any zippers and without getting out of the sleeping bag 10. Quite to the contrary, the user need only withdraw his or her feet 62 away from the foot extremities 37, 32, and 20 of the several layers 12, 24, and 36 of the sleeping bag 10. The user's feet 62 are pulled back out through the slit 34. The user then merely extends his or her feet 62 back beneath the lowermost portion of the lower body portion 30 of the main cover layer 24. The user's feet 62 are then located atop the lowermost portion 18 of the bottom layer 12 and are covered, not only by the top cover layer 36, but also by the main cover layer 24, as illustrated in FIG. 4. The user will employ the sleeping bag 10 with feet 62 inserted as illustrated in FIG. 4 to achieve the maximum conservation of body heat within the foot area of the sleeping bag 10.

Undoubtedly, numerous variations and modifications of the invention will become readily apparent to those familiar with articles of bedding. For example, the same structural combination of the main cover layer 24 and top cover layer 36 may utilized in the form of a blanket, completely separable from any underlying structure. Such a blanket may be utilized atop a bed to achieve the same alternative cooling or body heat conservation effects illustrated in the drawing figures. Also, many different types of releaseable fastening systems may be substituted for the zippers shown in the illustrated embodiment. Accordingly, the scope of the invention should not be construed as limited to the specific embodiment depicted and described, but rather is defined in the claims appended hereto.

I claim:

1. A bedding article for accommodating the body of a person comprising:

an elongated main cover layer of flexible material having an upper body portion and also a lower body portion with a foot extremity and including a transverse slit defined in said lower body portion between said upper body portion and said foot extremity, a top cover layer overlying said lower body portion of said main cover layer and secured thereto, and an elongated bottom layer of flexible material having an upper body portion with a head extremity and also a lower body portion with a foot extremity and said bottom layer is disposed beneath and permanently secured to said main cover layer, wherein all of said layers are each formed with opposing longitudinal edges and are all permanently joined to each other along at least one of said longitudinal edges.

2. A bedding article for accommodating the body of a person comprising:

an elongated main cover layer of flexible material having an upper body portion and also a lower body portion with a foot extremity and including a transverse slit defined in said lower body portion between said upper body portion and said foot extremity, a top cover layer overlying said lower body portion of said main cover layer and secured thereto, wherein said top cover layer has a foot extremity and further comprising an upper fastening system releasably joining said foot extremity of said top cover layer to said foot extremity of said main cover layer, and a flexible, ventilated mesh panel joined to and extending between said foot extremities of said top cover layer and said main cover layer.

3. A bedding article according to claim 2 wherein said flexible mesh panel is detachably joined to said foot extremities of said top cover layer and said main cover layer.

4. A bedding article for accommodating the body of a person comprising:

an elongated main cover layer of flexible material having an upper body portion and also a lower body portion with a foot extremity and including a transverse slit defined in said lower body portion between said upper body portion and said foot extremity, a top cover layer overlying said lower body portion of said main cover layer and secured thereto, wherein said top cover layer has a foot extremity and further comprising an upper fastening system releasably joining said foot extremity of said top cover layer to said foot extremity of said main cover layer, and an elongated bottom layer of flexible material having an upper body portion with a head extremity and also a lower body portion with a foot extremity, and a lower fastening system releasably joining said foot extremities of said main cover layer and said bottom layer together.

5. A sleeping bag comprising:

an elongated bottom mat formed of flexible material and having opposing head and foot extremities an elongated main cover also formed of flexible material and having head and foot extremities and overlying said bottom mat and permanently secured thereto and having a transverse slit defined therethrough between said head and foot extremities of said cover at a location closer to said foot extremity of said main cover than to said head extremity thereof and spaced from said foot extremity by about one to three feet, a top cover secured to said main cover and also formed of flexible material and overlying only a portion of said main cover including said foot extremity and said transverse slit of said main cover, wherein upper, transverse fastening elements are provided and releasably secure said foot extremities of said main cover and said top cover together, and a ventilated panel joining said foot extremities of said main cover and said top cover together.

6. A sleeping bag according to claim 5 wherein said ventilated panel is detachable from both said main cover and said top cover.

7. A sleeping bag comprising:

an elongated bottom mat formed of flexible material and having opposing head and foot extremities an elongated main cover also formed of flexible material and having head and foot extremities and overlying said bottom mat and permanently secured thereto and having a transverse slit defined therethrough between said head and foot extremities of said cover at a location closer to said foot extremity of said main cover than to said head extremity thereof and spaced from said foot extremity by about one to three feet, a top cover secured to said main cover and also formed of flexible material and overlying only a portion of said main cover including said foot extremity and said transverse slit of said main cover, wherein upper, transverse fastening elements are provided and releasably secure said foot extremities of said main cover and said top cover together, and wherein said upper, transverse fastening elements are formed of a pair of transverse upper strips of engageable zipper teeth respectively secured to said foot extremities of said main cover and said top cover, and further comprising a zipper slide for releasably meshing said engageable zipper teeth of said upper strips together.

8. A sleeping bag comprising:

an elongated bottom mat formed of flexible material and having opposing head and foot extremities an elongated main cover also formed of flexible material and having head and foot extremities and overlying said bottom mat and permanently secured thereto and having a transverse slit defined therethrough between said head and foot extremities of said cover at a location closer to said foot extremity of said main cover than to said head extremity thereof and spaced from said foot extremity by about one to three feet, a top cover secured to said main cover and also formed of flexible material and overlying only a portion of said main cover including said foot extremity and said transverse slit of said main cover, wherein upper, transverse fastening elements are provided and releasably secure said foot extremities of said main cover and said top cover together, wherein lower, transverse fastening elements are provided and releasably secure said foot extremities of said main cover and said bottom mat together, and wherein said lower transverse fastening elements are formed of a pair of transverse lower strips of engageable zipper teeth respectively secured to said foot extremities of said main cover and said bottom mat, and further comprising a zipper slide for releasably meshing said engageable zipper teeth of said lower strips together.

9. In a sleeping bag including an elongated, flexible bottom mat with opposing first and second longitudinally arranged portions, an elongated main cover secured to said bottom mat and having opposing first and second longitudinally arranged portions respectively overlying said first and second portions of said bottom mat, the improvement comprising an upper top cover having opposing longitudinal extremities and overlying only said second portions of said main cover and said bottom mat, wherein a slit is defined through and transversely across said second portion of said main cover between said longitudinal extremities of said upper top cover, and wherein said bottom mat, said top cover, and said main cover all have foot extremities and further comprising a flexible ventilated mesh panel connected across said foot extremities of said top cover and said main cover.

10. A sleeping bag according to claim 9 wherein said ventilated mesh panel is detachable from both said top cover and said main cover.

11. A sleeping bag according to claim 9 further comprising upper and lower transverse releaseable fastening systems at said foot extremities of said bottom mat, said top cover, and said main cover, and said upper releaseable fastening system extends transversely across and releasably joins said top cover and said main cover together at said foot extremities thereof, and said lower releaseable fastening system extends transversely across and releasably joins said main cover and said bottom mat together at said foot extremities thereof, and wherein said upper and lower transverse releaseable fastening systems are both zippers.

* * * * *